US010799404B2

(12) United States Patent
Harris

(10) Patent No.: US 10,799,404 B2
(45) Date of Patent: Oct. 13, 2020

(54) CLAMP MECHANISM FOR LITTER

(71) Applicant: Michael W. Harris, Washington, DC (US)

(72) Inventor: Michael W. Harris, Washington, DC (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 74 days.

(21) Appl. No.: 16/205,614

(22) Filed: Nov. 30, 2018

(65) Prior Publication Data

US 2020/0170855 A1 Jun. 4, 2020

(51) Int. Cl.
*A61G 1/04* (2006.01)
*A61G 7/05* (2006.01)
(Continued)

(52) U.S. Cl.
CPC ..... *A61G 1/04* (2013.01); *A47C 21/00* (2013.01); *A61G 7/0503* (2013.01); *A61G 13/101* (2013.01)

(58) Field of Classification Search
CPC ..... A47C 21/00; A47C 31/00; A61G 7/05; A61G 7/0503; A61G 13/10; A61G 13/101;
(Continued)

(56) References Cited

U.S. PATENT DOCUMENTS 4,557,453 A * 12/1985 McCloskey ..... A61G 7/05 248/283.1
5,598,592 A 2/1997 Castellani ..... 5/627
(Continued)

OTHER PUBLICATIONS

Talon II® Model 90C Ultimate Evacuation Litter http://www.defpnavymd.org/ 03 New Talon Pole Litter.pdf.
(Continued)

*Primary Examiner* — Robert G Santos
(74) *Attorney, Agent, or Firm* — Gerhard W. Thielman

(57) ABSTRACT

A clamping mechanism is provided far attaching an instrument to a litter pole. The mechanism includes a platform, a base, first and second clamps, a quick-release pin and first and second thumb screws. The platform attaches the instrument and includes an elongated plate terminating in serifs at both ends. The base disposes the platform and includes a floor bounded by corner posts that extend above the floor, a block that extends below the floor, and a flange. The flange extends below the floor opposite the block, and the flange includes a first hinge. The clamp pivots on the base between the black and the flange. The clamp includes a second hinge that engages the first hinge, a curve member that connects to the second hinge for receiving the pole, and a tang that connects to the curve member. The spacer includes a convex surface to engage a joint on the pole and a flat surface opposite the convex surface to engage the block. The quick-release pin inserts through an adjacent pair of the corner posts disposed between the serifs. The first thumb-screw passes through the tang and into the block. The second thumb screw passes through the block and against the spacer to press towards the joint.

4 Claims, 6 Drawing Sheets

(51) Int. Cl.
*A61G 13/10* (2006.01)
*A47C 21/00* (2006.01)

(58) Field of Classification Search
CPC . A61G 1/00; A61G 1/013; A61G 1/04; F16M 13/00; F16M 13/02; F16M 13/022
USPC ..... 5/503.1, 658, 663, 625–629; 248/214, 248/220.21, 221.11
See application file for complete search history.

(56) References Cited

U.S. PATENT DOCUMENTS 5,836,026 A * 11/1998 Reed ..... A61G 7/0533 5/662
6,431,505 B2 * 8/2002 Chinn ..... A61M 5/1415 248/121
6,842,923 B1 * 1/2005 Castellani ..... A61G 1/013 16/228
7,376,992 B2 * 5/2008 Salt ..... A61G 1/04 5/503.1
7,523,514 B2 * 4/2009 Salt ..... A61G 1/04 128/845
8,011,629 B2 * 9/2011 Herskovic ..... A61G 7/0503 248/229.13
8,104,124 B2 * 1/2012 Awerbuch ..... A61G 1/013 5/111
8,327,482 B2 * 12/2012 Awerbuch ..... A61G 1/013 5/114
8,327,492 B2 12/2012 Awerbuch et al. ..... 5/627
8,661,583 B2 * 3/2014 Chinn ..... A61G 1/04 248/221.11
8,863,333 B2 * 10/2014 Cain ..... A61G 1/013 5/626
9,545,346 B2 * 1/2017 Chinn ..... A61G 1/04
10,010,460 B2 * 7/2018 Sirkin ..... A61G 13/105
2002/0011543 A1 * 1/2002 Chinn ..... A61M 5/1415 248/121
2005/0028283 A1 * 2/2005 Castellani ..... A61G 1/013 5/627
2007/0017030 A1 * 1/2007 Salt ..... A61G 1/04 5/621
2007/0267556 A1 * 11/2007 Herskovic ..... A61G 7/0503 248/218.4
2008/0301874 A1 * 12/2008 Salt ..... A61G 1/04 5/425
2009/0000035 A1 * 1/2009 Awerbuch ..... A61G 1/013 5/627
2012/0102651 A1 * 5/2012 Awerbuch ..... A61G 1/013 5/627
2012/0126075 A1 * 5/2012 Chinn ..... A61G 1/052 248/221.11
2012/0241571 A1 * 9/2012 Masionis ..... A61G 1/04 248/214
2013/0145554 A1 * 6/2013 Cane ..... A61M 5/1417 5/626
2014/0124637 A1 * 5/2014 Chinn ..... A61G 7/00 248/221.11
2018/0000666 A1 * 1/2018 Sirkin ..... A61G 1/052
2018/0104120 A1 * 4/2018 Sirkin ..... A61G 1/04

OTHER PUBLICATIONS

HotDog Product Catalog http://hotdogwarming.com/wp-content/uploads/M100_ProductCatalogue.pdf.

* cited by examiner

CLAMP MECHANISM FOR LITTER

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to clamping mechanisms. In particular, the invention relates to a clamping mechanism for securing a medical monitor to a litter or gurney.

Treatment of United States Marines on the battlefield necessitates rapidly moving a wounded body without furthering injury and monitoring metabolic conditions. Such endeavors include laying the body onto a NATO litter—a collapsible gurney or stretcher intended for transport by human-locomotion—and providing a medical monitor.

SUMMARY

Conventional attaching mechanisms for medical monitors onto an emergency stretcher yield disadvantages addressed by various exemplary embodiments of the present invention. In particular, various exemplary embodiments provide a clamping mechanism for attaching an instrument to a litter pole. The mechanism includes a platform, a base, a clamp, a spacer, a quick-release pin and first and second thumb screws. The platform attaches the instrument and includes an elongated plate terminating in serifs at both ends.

The base disposes the platform and includes a floor bounded by corner posts that extend above the floor, a block that extends below the floor, and a flange. The flange extends below the floor opposite the block, and the flange includes a first hinge. The clamp pivots on the base between the block and the flange. The clamp includes a second hinge that engages the first hinge, a curve member that connects to the second hinge for receiving the pole, and a tang that connects to the curve member. The spacer includes a convex surface to engage a joint on the pole and a flat surface opposite the convex surface to engage the block. The quick-release pin inserts through an adjacent pair of the corner posts disposed between the serifs. The first thumb-screw passes through the tang and into the block. The second thumb screw passes through the block and against the spacer to press towards the joint.

BRIEF DESCRIPTION OF THE DRAWINGS

These and various other features and aspects of various exemplary embodiments will be readily understood with reference to the following detailed description taken in conjunction with the accompanying drawings, in which like or miler numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed, description is, therefore, not to be taken in a limiting sense, and the scope of the present invention is defined only by the appended claims.

The disclosure generally employs quantity units with the following abbreviations: length in inches (in), mass in pounds ($Ib_m$), time in seconds (s) and electric potential in volts (V). Supplemental measures can be derived from these, such as moment of inertia in pounds-square-inches ($Ib_m$-$in^2$) and the like.

Exemplary embodiments describe a vertical clamp that secures to either of the round support poles on the NATO litter, a horizontal clamp that pushes against the folding joint of the NATO litter, and a mounting plate atop the device to which a medical monitor or related equipment attaches. The vertical clamp is tightened via a threaded thumb screw and is the primary mechanism of securing to the litter. The horizontal clamp attaches to the mount by two small screws that slide through the main mount body and enable this clamp to move a small distance on the horizontal plane.

A second, smaller thumb screw forces the horizontal clamp against a flat surface on the joint of the NATO litter and ensures the full mount securely attaches without movement. The mounting plate is multi-directional and enables equipment to the secured to the mount in four different configurations, each perpendicular to each other. A mating receiver plate bolts to the equipment to be mounted and fits tightly into recesses on the mounting plate. The two quick release pins secure the receiver plate to the mount.

The tight connection prevents rubbing and shaking during movement, such as during transport on a military vehicle on unimproved roads or uneven terrain. The mount is secured with two thumb screws and equipment is secured to the mount via two quick release pins. This enables equipment to attach to the litter quickly. The exemplary mount is small and light weight. Its positioning on the litter, directly over one of the poles used to carry the litter, aids in reduction of effect of the added weight to the litter, caused by the medical monitor equipment (at least for the patient warming controller, which has a low center of mass and is centered directly over the mount).

Figure 1:
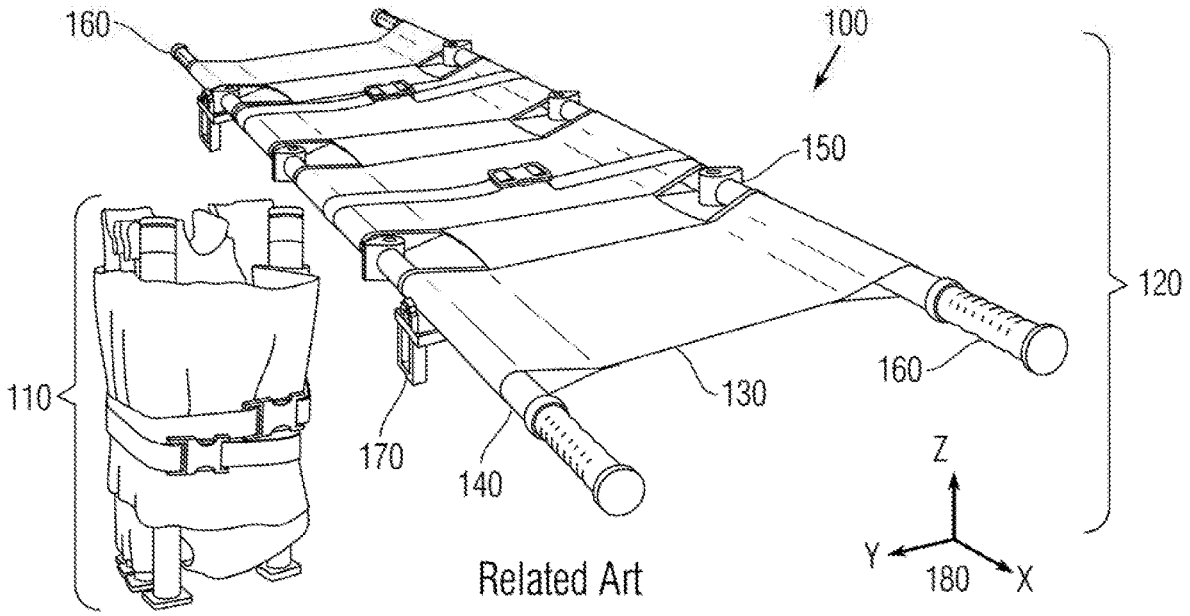
FIG. 1 is a perspective view of a NATO litter.

FIG. 1 shows a perspective view 100 of a conventional NATO littler as stowed 110 and deployed 120. A fabric mesh 130 stretches between two support poles 140 to carry a prone human body for rapid egress. Joints 150 along the pole 140 enable the litter to fold or unfold. The poles 140 terminate in handle grips 160 and include feet 170 for setting on a floor. The poles 140 include folding joints to collapse the litter for stowage.

The Talon II Model 90C litter is described in U.S. Pat. No. 5,598,592 and at http://www.dcfpnaymil.org/03New talon Pole Litter.pdf. A compass rose 180 provides orientation for description of components for attaching to the poles 140: X denotes axial direction along the litter length (towards rear), Y denotes lateral direction (towards port) along the width, and Z denotes the vertical direction (upward). When unfurled, the deployed litter 120 extends 90 inches in length and weighs 16 $lb_m$.

Figure 2:
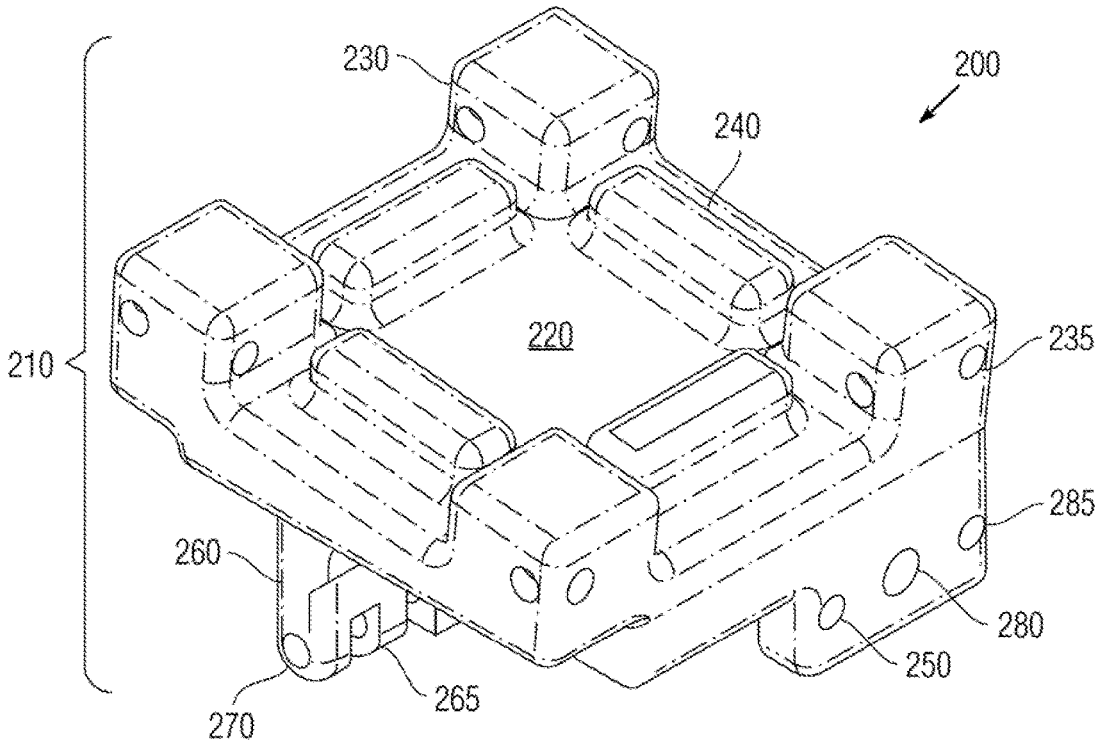
FIG. 2 is an isometric view of a base.

FIG. 2 shows an isometric view 200 of an exemplary base mount 210. A square floor 220 is bounded at the corners by raised posts 230 pierced by through-holes 235, and along the sides by merlons 240 extending above the floor 220. The posts 230 and merlons 240 are separated by crenels (e.g., gaps). A block 250 and a hinge flange 260 extend beneath the platform 220 opposite each other.

The mount 210 can be described as upper and lower portions. The upper portion includes the floor 220 with the posts 230 and merlons 240. The lower portion includes the block 250 and the hinge flange 260 and attaches to the upper portion at a tilt angle. The hinge flange 260 includes slotted extensions 265 having through-holes 270 for receiving a pivot shaft. The block 250 includes holes 280 for receiving a threaded bolt, and through-holes 285 for inserting hex-bolts. The mount 210 has length and width of 4.02 inches, and height of 3.37 inches, and can be composed of aluminum alloy 6061-T6.

Figure 3:
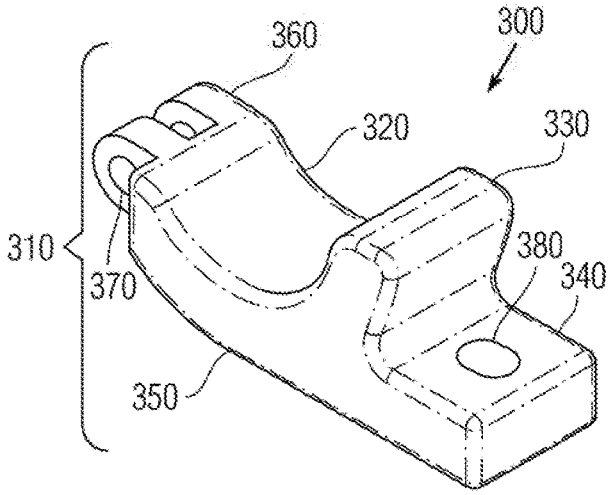
FIG. 3 is an isometric view of a horizontal clamp.

FIG. 3 shows an isometric view 300 of an exemplary clamp 310. A curved top surface 320 having a radius of 0.775 inch receives the pole 140, which is laterally restrained by an elevation 330 A tang 340 extends laterally beyond the elevation 330. A bottom surface 350 is disposed opposite the top surface 320, elevation 330 and tang 340. The top surface 320 and elevation 330 engage the pole 140. Hinge slots 360 extend laterally from top surface 320 opposite the elevation 330 and include through-holes 370. The tang 340 includes a through-hole 380 with an elongated diameter of 0.313 inch. The clamp 310 has length of 3.25 inches, width of 1.00 inch, and height of 1.28 inches, and can be composed of aluminum alloy 6061-T6.

Figure 4:
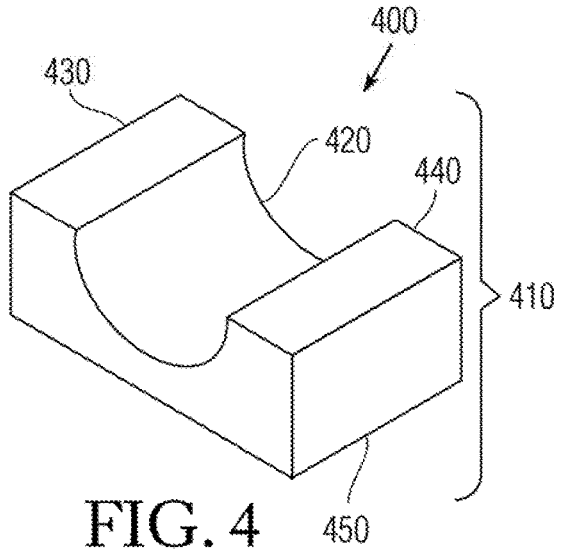
FIG. 4 is an isometric view of a vertical clamp.

FIG. 4 shows an isometric view 400 of an exemplary vertical spacer 410. A convex surface 420 wedges between the mount 210 and a folding joint 150 on the pole 140. Lateral ends 430 and 440 flank the convex surface 420. A flat surface 450 extends across the ends 430 and 440 opposite the curved surface 420. The flat surface 450 includes elongated cavities (not shown) at the ends 430 and 440. The spacer 410 has length of 1.65 inches, width of 1.00 inches, and height of 0.65 inch with a radius of 0.45 inch cutout along the surface 420, and can be composed of structural steel as per ASTM A36.

Figure 5:
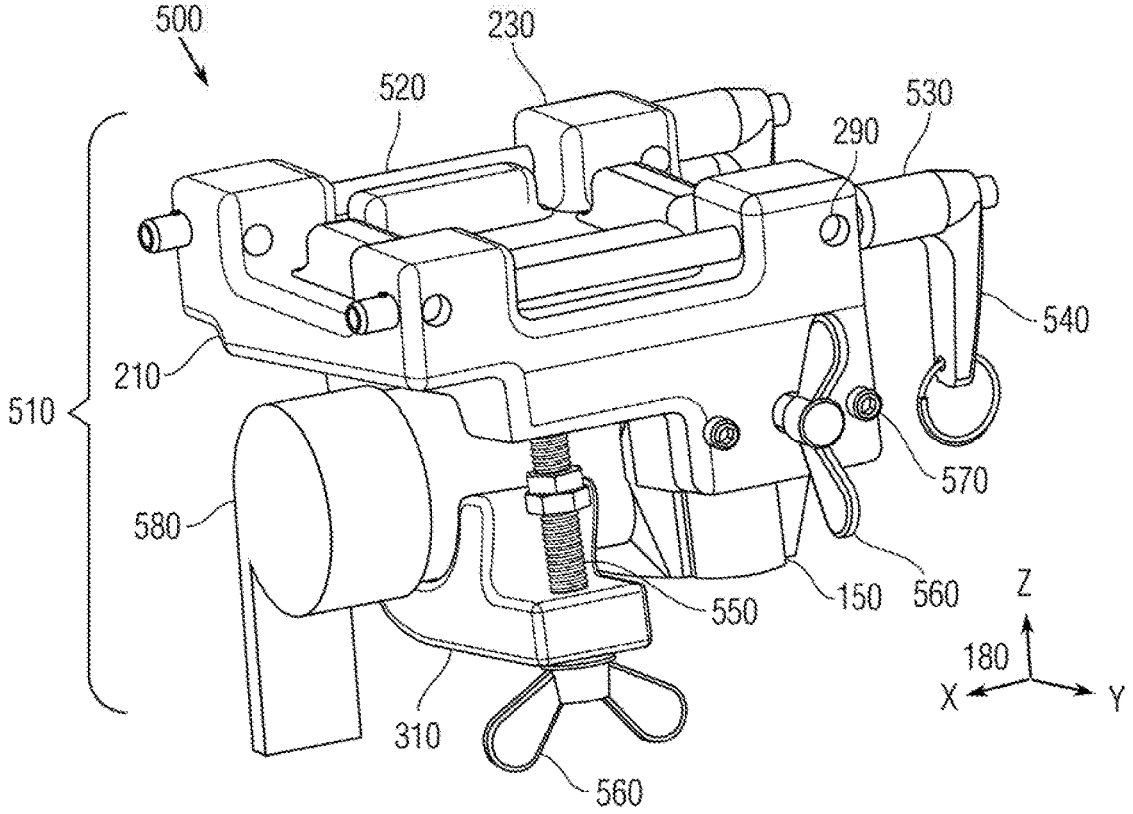
FIG. 5 is an isometric view of a clamping assembly.

FIG. 5 shows an isometric view 500 of an exemplary clamping assembly 510 on a pole 140. Release pins 520 extend in parallel through holes 290 of two posts 230 separated center-to-center by 3.50 inches. Each pin 520 includes a stop 530 that connects to a turn handle 540, ending in an optional pull-ring. A first threaded thumb-screw 550 passes through the hole 380 for attaching to the block 250 and terminates in a wing-nut 560. A second thumb-screw extends through the hole 280 to press the spacer 410 against the litter joint 150, also terminating in another wing-nut 560. Hex-head bolts 570 are inserted in alignment holes 285 for insertion into the cavities in the flat surface 450 to secure the mount 210 and spacer 410 together. The mount 210 and clamp 310 engage the pole 140. The mount 210 and spacer 410 engage the joint 150.

Figure 6A:
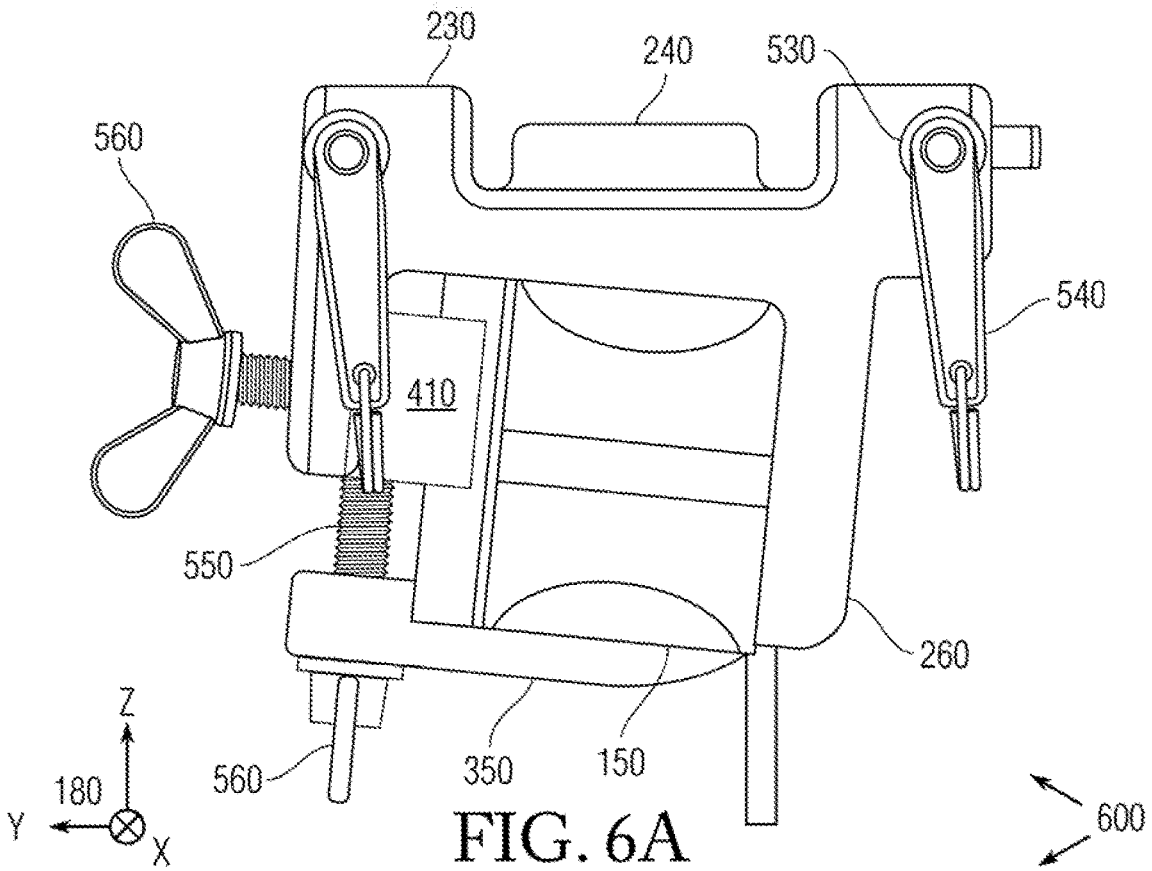
FIGS. 6A, 6B and 6C are elevation views of the clamping assembly.
Figure 6B:
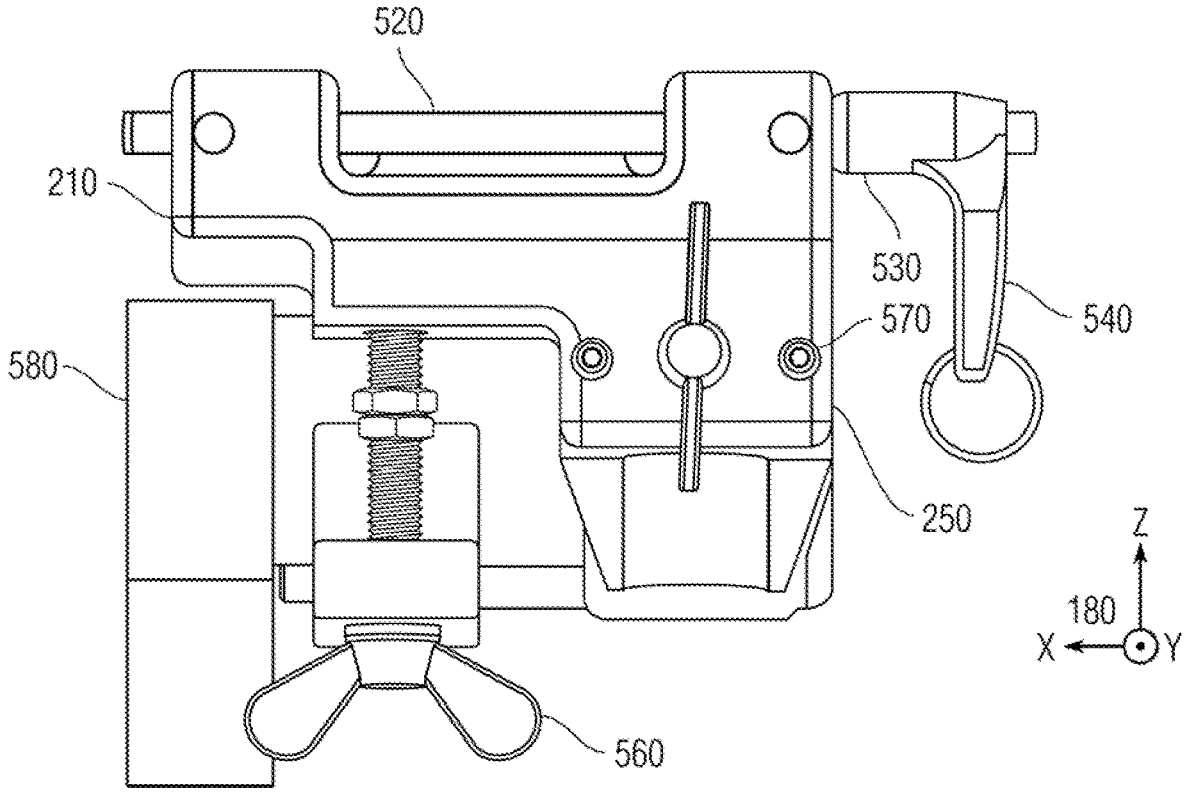
Figure 6C:
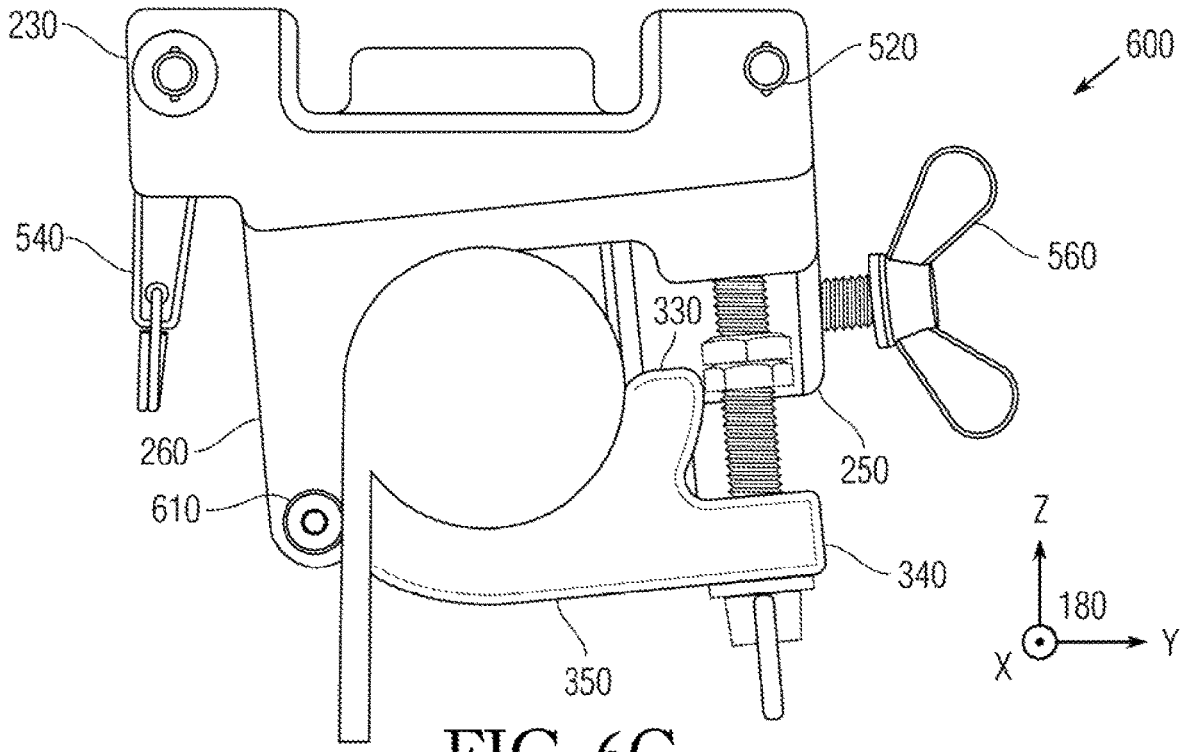

FIGS. 6A through 6C show elevation views 600 of the exemplary clamp assembly. In FIG. 6A, the assembly is shown facing forward from behind. The hinge flange 260 of the mount 210 tilts from vertical to join the hinge slots 360 of the clamp 310. Similarly, the block 250 also tilts from vertical to press the spacer 410 against the pole 140. In FIG. 6B, the assembly is shown facing starboard from the port side as indicated by the compass rose 180. The hex-head bolts 570 flank the wing-nut 560 for the second thumb-screw to secure the mount 210 and the spacer 410 together. In FIG. 6C, the assembly is shown facing aft from in front. A hinge bolt 610 passes through holes 270 of the flange 260 and holes 370 of the slots 360 to enable the clamp 310 to pivot on the mount 210. This ability enables the clamping assembly 510 to readily engage and disengage the pole 140.

Figure 6D:
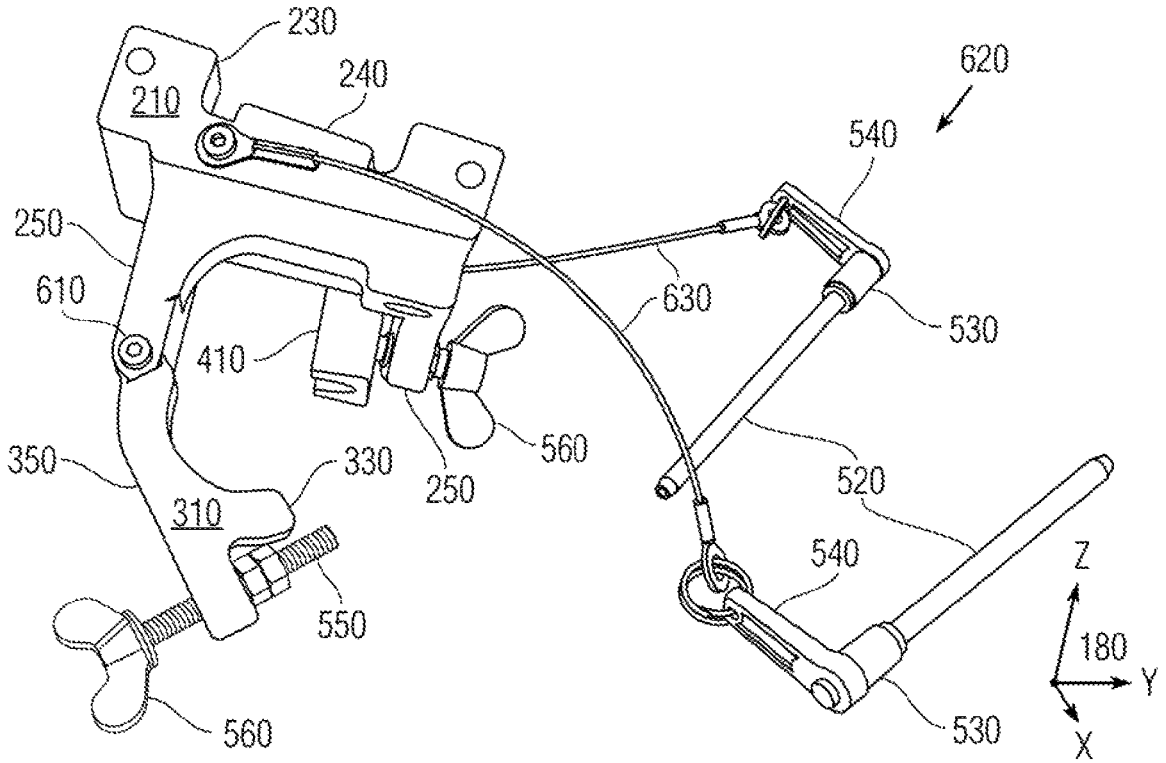
FIG. 6D is a perspective view of the clamping assembly.

FIG. 6D shows a perspective view 620 of the clamping assembly 510 separated from the pole 140. The hinge 610, shown open, connects the mount 210 with the clamp 310. Upon closing the hinge 610, the elevation 330 is disposed forward of the block 250 and the spacer 410. The rods 520 are disconnected from the holes 235, and the handles 540 flexibly attach to the mount 210 by wire lanyards 640 to avoid misplacement.

Figure 7A:
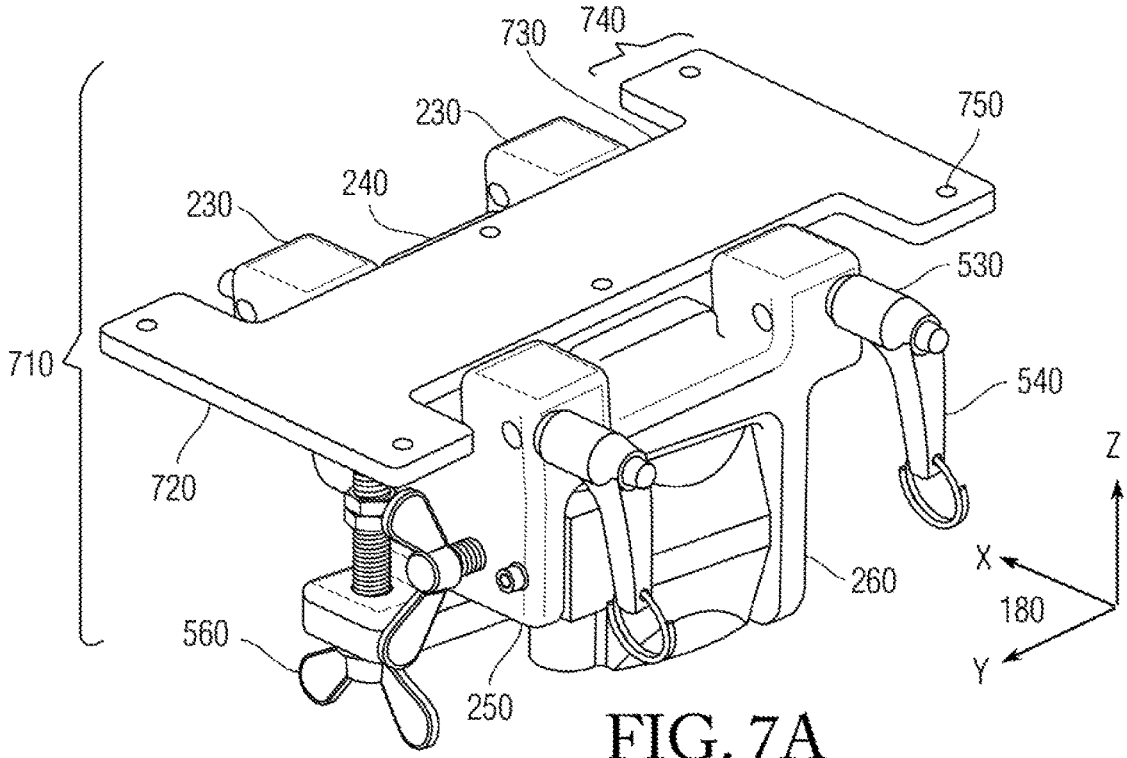
FIGS. 7A and 7B are isometric views of a bracket mount.
Figure 7B:
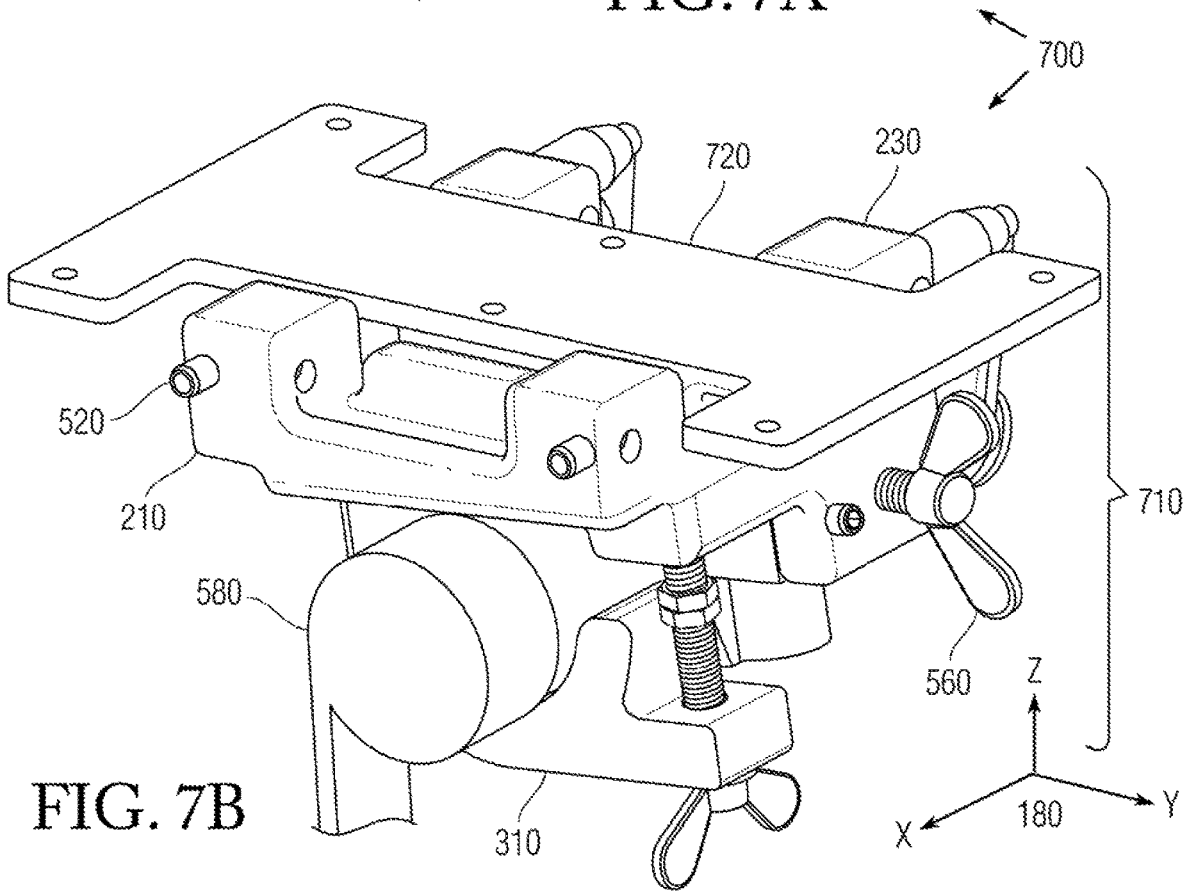

FIGS. 7A and 7B show isometric views 700 of an exemplary mount assembly 710 including a mating plate 720 that serves as a platform across the port and starboard sides of the clamp assembly 510. In FIG. 7A, the lateral direction faces substantially left, whereas in FIG. 7B, the lateral direction faces substantially right. A bridge 730 rests atop laterally spaced merlons 240 between the posts 230. A pair of opposite brackets or serifs 740 flank the bridge 730. Each bracket 740 includes through-holes 750 at the bracket corners and bridge edges for mounting medical equipment. The pins 520 releasably secure the plate 720 to the mount 210. The plate 720 has a length of about 6.5 inches and a width of about 4.0 inches and can be composed of aluminum alloy.

Figure 8:
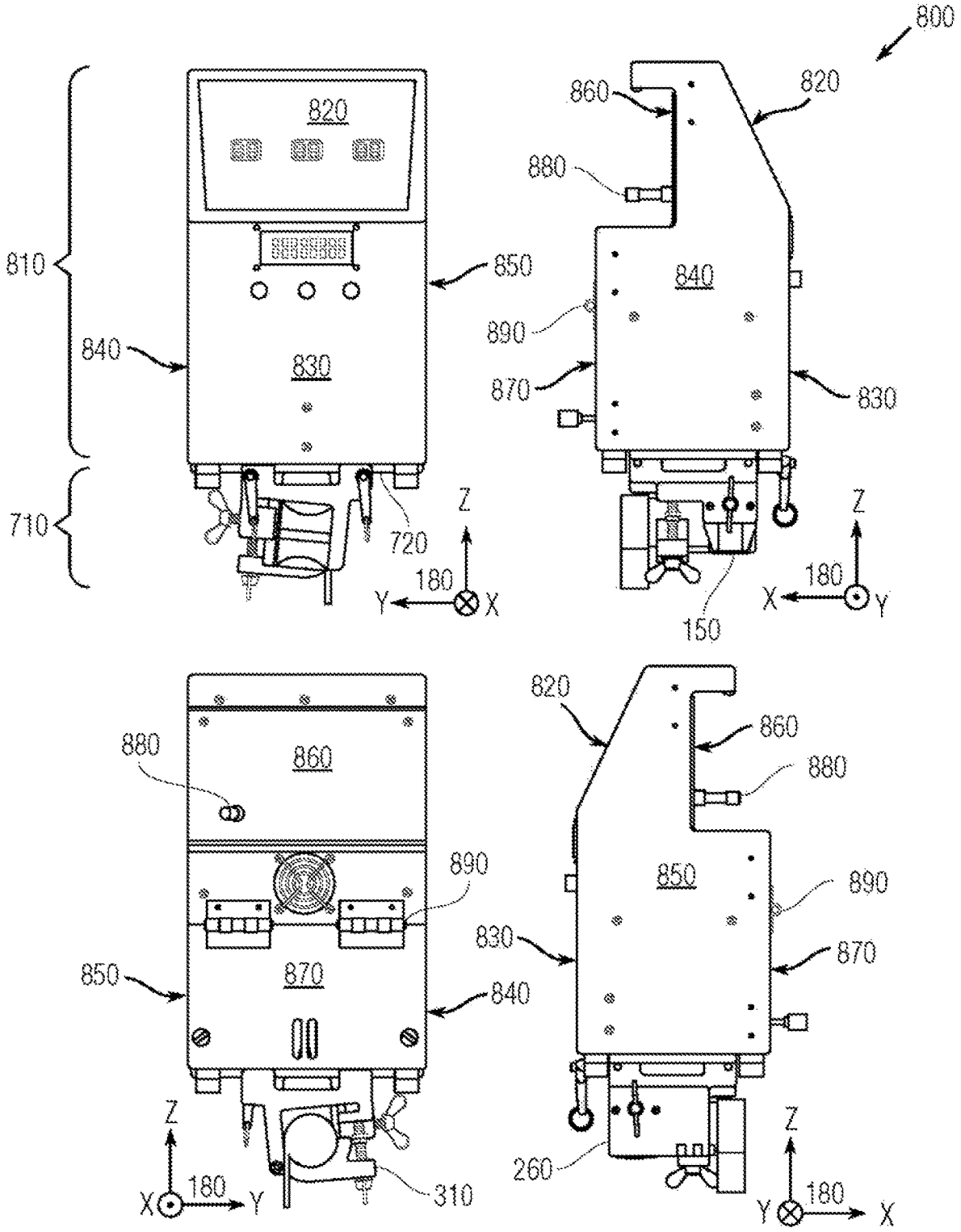
FIG. 8 is a set of elevation views of a medical monitor clamping assembly.

FIG. 8 shows a set of elevation views 800 of a medical instrument 810 attached to the mount assembly 710. The instrument 810 is customized from a WC52 controller from HotDog for warming patients, described at http://hotdog-warming.com/wp-content/uploads/ M100_ProductCatalogue.pdf, from Eden Prairie, Minn. and modified to run exclusively on 2590 lithium-ion batteries at 28 V direct current (DC) rather than 120 V alternating current (AC). The WC52 has dimensions of 13"H×7¾"W×5½"D and weighs 11 $lb_m$. The upper left quadrant view faces forward from behind, analogous to the view of FIG. 6A. The upper right quadrant faces starboard from the port side, analogous to the view of FIG. 6B. The lower right quadrant faces port from the starboard side. The lower left quadrant faces aft from in front, analogous to the view of FIG. 6C.

The instrument 810 attaches to the plate 720 by six screws at the corner and edge holes 750. As shown the instrument 810 includes a slant upper face 820 and vertical lower face 830 on the aft side, and flanked by a port face 840 and a starboard face 850. The instrument 810 also includes an indent recess upper face 860 and a hinged lower face 870. The upper face 860 includes a toggle switch 880, whereas the lower face 870 includes a panel hinge 890 for internal access of the instrument 810.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A clamping mechanism for attaching an instrument to a pole at a joint along a litter, said mechanism comprising:

a platform for attaching the instrument, said platform including an elongated plate that terminates in serifs at opposite ends of said plate;

a base for disposing said platform, said base including a floor bounded by corner posts that extend above said floor, a block that extends below said floor, and a flange that extends below said floor opposite said block, said flange having a first hinge;

a clamp for pivoting on said base between said block and said flange, said clamp including a second hinge that rotatably engages said first hinge, a curve member that connects to said second hinge for receiving the pole, and a tang that connects to said curve member;

a spacer for disposition adjacent said clamp, said spacer including a convex surface to engage the joint and a flat surface opposite said convex surface to engage said block;

a quick-release pin for inserting through an adjacent pair of said corner posts disposed between said serifs;

a first thumb-screw for passing through said tang and into said block; and a second thumb screw for passing through said block and against said spacer for pressing towards the joint.

2. The mechanism according to claim 1, wherein said platform, said base and said clamp are composed of aluminum alloy.

3. The mechanism according to claim 1, wherein said space is composed of steel.

4. The mechanism according to claim 1, said base further includes merlons extending from said floor being disposed between said posts.

* * * * *